United States Patent [19]

Vancura

[11] Patent Number: 4,682,662

[45] Date of Patent: Jul. 28, 1987

[54] DRILL ADAPTER

[76] Inventor: Vladimir Vancura, Brudsporregränd 6, S-162 45 Vällingby, Sweden

[21] Appl. No.: 727,224

[22] Filed: Apr. 25, 1985

[51] Int. Cl.[4] ..... E21B 10/26; E21B 17/00

[52] U.S. Cl. ..... 175/320

[58] Field of Search ..... 175/320, 325, 258, 350, 175/398, 399, 393; 403/350, 351, 409.1, DIG. 8; 285/178

[56] References Cited

U.S. PATENT DOCUMENTS

| | | | |
|---|---|---|---|
| 3,174,563 | 3/1965 | Edblom et al. | 175/325 X |
| 3,277,972 | 10/1966 | Lagerstrom | 175/399 |
| 3,416,616 | 12/1968 | Ahlgren | 175/399 X |
| 4,440,244 | 4/1984 | Wiredal | 175/398 X |

*Primary Examiner*—Stephen J. Novosad

*Attorney, Agent, or Firm*—Burns, Doane, Swecker & Mathis

[57] ABSTRACT

A soil and rock drill adapter intended for coupling a rotatable drill rod to a drill bit, optionally with intermediate percussion drilling means or compressed-air drilling means, is arranged to permit the drill bit to be positioned eccentrically in relation to the longitudinal axis of the drill rod. To this end the adapter comprises two mutually connecting parts arranged one above the other and abutting each other in a plane extending at right angles to the longitudinal axis of the drill rod, and means being provided which enable two adapter parts to be adjusted relative one another between an eccentric position and a centric position relative to said axis.

4 Claims, 5 Drawing Figures

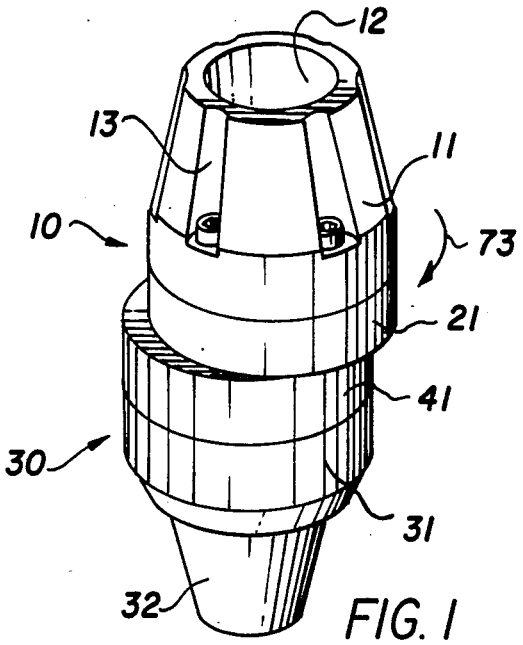
FIG. 1
FIG. 2
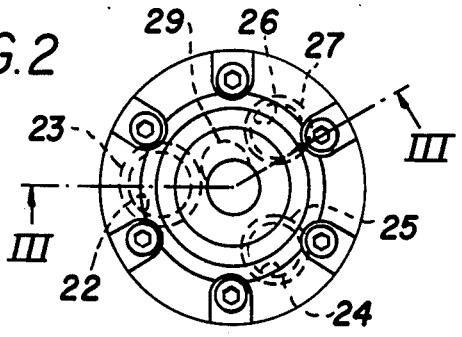
FIG. 4
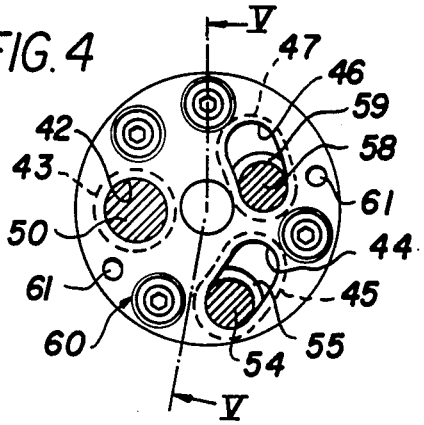
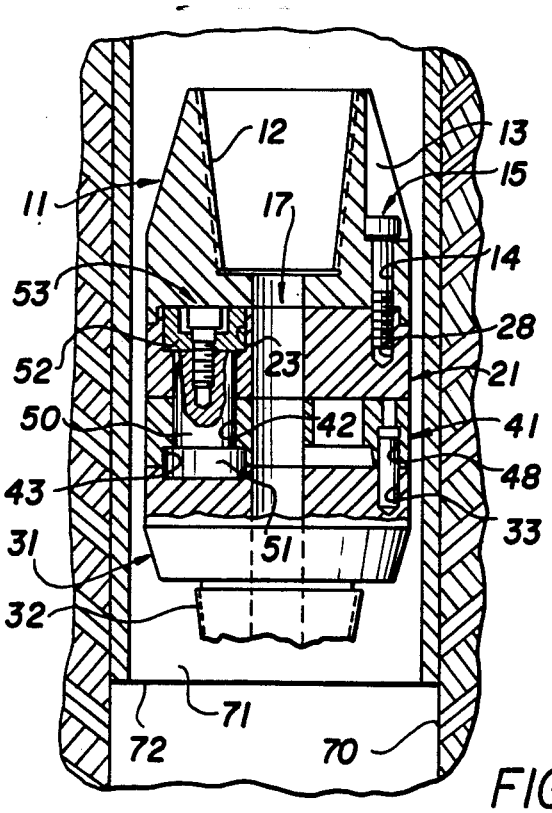
FIG. 3
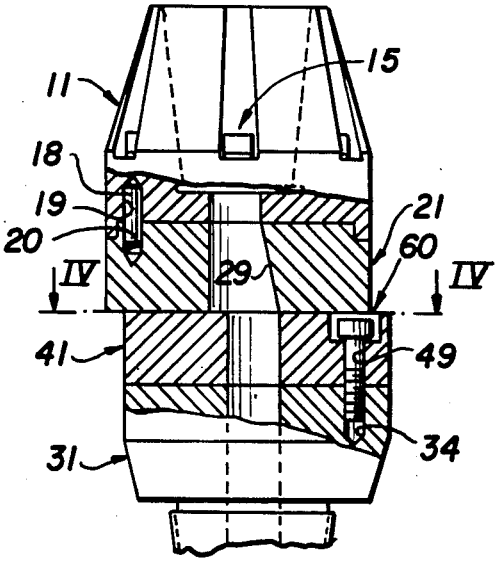
FIG. 5

DRILL ADAPTER

TECHNICAL FIELD

The present invention relates to a drill adapter intended for rock and soil drilling operations and being of the kind adapted for connection between a drill rod and a drill bit in a manner to allow the drill bit to be positioned eccentrically in relation to the geometric longitudinal axis of the drill rod. The use of such an adapter enables holes of larger diameter than that of the drill bit to be drilled by causing the bit to rotate around the axis of the drill rod during a drilling operation.

BACKGROUND ART

A known drill adapter of this kind includes a forward part, to which the drill bit is attached, and a rearward part, said parts being rotatably joined at an inclined abutment surface common to both parts, so that when the forward adapter part is rotated relative to the rearward part said part is swung outwardly and angled obliquely to the geometric longitudinal axis of the drilling rod.

Another known device for eccentric compressed-air drilling purposes includes a so-called off-center drill bit which comprises a guide, an especially designed pilot drill, and a reamer arranged therebetween. The eccentric function of this device is achieved through the reamer, which by rotating the same through 180° can be moved radially outwards and inwards relative to the pilot drill located in the drill hole and in front of the reamer.

DISCLOSURE OF THE INVENTION

An object of the present invention is to provide an improved drill adapter of the kind described in the introduction to which there can be connected a conventional drilling bit which can be adjusted between a centric and eccentric position without being positioned obliquely in the drill hole.

Accordingly, this invention relates to a soil and rock drill adapter arranged for coupling between a rotatable drill rod and a drill bit such that the drill bit can be positioned eccentrically in relation to the longitudinal axis of the drill rod, wherein the adapter comprises two mutually connected parts which abut each other in a plane extending at right angles to the longitudinal axis of the drill rod, and which can be mutually adjusted between an eccentric position relative to said axis.

BRIEF DESCRIPTION OF THE DRAWINGS

The invention will now be described in more detail with reference to the accompanying drawing, in which FIG. 1 is a perspective view of a drill adapter according to the invention;

FIG. 2 is a schematic view from above showing the adapter in a centric position;

FIG. 3 is a part sectional view taken on the line III—III in FIG. 2 with the adapter placed in a drill hole;

FIG. 4 is a cross-sectional view taken on the line IV—IV in FIG. 5; and

FIG. 5 is a part sectional view taken on the line V—V in FIG. 4.

DESCRIPTION OF A PREFERRED EMBODIMENT

The drill adapter illustrated in FIG. 1 comprises mainly two parts, i.e. an upper part 10 and a lower part

30 which can be adjusted positionally in relation to the upper part 10, between a centric and an eccentric position. The upper adapter part 10 has a connecting end 11 provided with an internal screwthread 12 (for example an API-type screwthread) for connecting the adapter to one end of a drill rod (not shown), optionally via an intermediately connected down-the-hole drill or a hammer means, and presents a journal or bearing plate 21. Correspondingly, the lower adapter part 30 has a journal or bearing plate 41 and a connecting end 31 on which there is provided an external screwthread 32 for connecting the adapter to a conventional drill bit not shown.

In order to enable the adapter to be used for impact drilling purposes (hammer drilling, compressed-air drilling) in addition to rotary drilling, there extends through the adapter a central channel 17 (FIG. 3) which provides a free axial passage between the two adapter parts, both in the centric and eccentric positions thereof.

In addition to a section of the central channel 17, the lower journal plate 41 presents a plurality of axial recesses or notches (FIG. 4) for pivotally journalling the lower adapter part 30 to the upper part 10 and for attaching the journal plate 41 to the lower connecting end 31.

When turning to FIGS. 3 and 4 it will be seen that journalling of the two adapter parts for pivotal action between the aforesaid two positions is effected by providing the lower journal plate 41 with firstly an eccentrically located bore 42 which merges with a lower bore-enlargement 43 which accommodates from beneath a pivot peg 50 having an enlarged bottom-head 51, and secondly two slots 44,46 which are spaced from the bore 42 and extend in circular-arcuate fashion thereto and which exhibit lower slot-enlargements 45,47 each of which receives from beneath a pivot-restricting peg 54 and 58 having a respective enlarged lower head portion 55 and 59.

To facilitate attachment of the journal plate 41 to the upper side of the lower connecting end 31 there are provided firstly two guide pins 61,61 each of which is accommodated in a respective bore 48 in the plate 41 (FIG. 3) and a respective bore 33 in the lower connecting end 31, and secondly four screw-joint means 60 let into the plate 41 and accommodated in bores 49 and screwthread holes 31 respectively (FIG. 5).

As will be seen from FIGS. 2 and 3, the upper journal plate 21 has three throughpassing bores 22,24,26 which accommodate the pegs upstanding from the lower bearing plate 41, i.e. the pivot peg 50 and the pivot-restricting pegs 54 and 58 (FIG. 4). The upper journal plate 21 is secured to the pegs 50, 54 and 58 by means of similar screw-joints—of which only the joint comprising screw 53, enlarged bush 52 for the pivot peg 50 is shown in FIG. 3—arranged in holes 23, 25 and 27 respectively.

The upper connecting end 11 of the adapter is connected with the upper journal plate 21 by means of two guide pins accommodated in respective blind bores, of which guide pins one 18 is illustrated in FIG. 5 accommodated in blind bores 19 and 20, and by means of a plurality of circumferentially distributed and uniformly spaced screw connections which, as will be seen from FIG. 3, are let into the upper surface of the connecting end 11 as shown at 13 and extend through bores 14 in said connecting end 11 to engage screw-threaded bores 28 in the upper journal plate 21.

As will be seen from FIGS. 2 and 5, the lower part of the central channel is widened, at 29, in the upper journal plate 21, so as not to choke the air flow when the adapter is adjusted to its eccentric position and used for compressed-air drilling purposes.

A drill adapter according to the present invention is intended to be used in the following manner.

Prior to drilling the upper connecting end 11 of the adapter is screwed, with the aid of screwthread 12, to one end of a drill rod (not shown) or, in the case of impact drilling, to an intermediate hammer assembly. The lower connecting end 31 is screwed directly to a drill bit, via the screwthread 32.

For the sake of simplicity it will now be assumed that the thus described adapter arrangement is lowered for continued drilling in a formed drill hole 70 (FIG. 3) into which a casing tube 21 has been driven to an extent such as to leave sufficient space between the underside 72 of the casing tube 71 and the bottom of the drill hole to accommodate the active part of the drill bit when seen vertically.

During subsequent drilling the drill rod located centrally in the drill hole will rotate, and therewith also the adapter, in the direction of arrow 73 (FIG. 1). When the drill bit engages the bottom of the drill hole 70, the lower part 30 of the adapter will be twisted in the opposite direction around the pivot peg 50 relative to the upper adapter part 10, to the eccentric position defined by the pegs 54,58. In this way, the center part of the drill bit will circle around the axis of the drill rod, so that the drill hole established by the drill bit will obtain a radius corresponding to the sum of the radius of the drill bit and the eccentricity of the adapter. If it is elected to exceed the thickness of the casing tube by an amount which is greater than the difference between the inner radius of the casing tube and the radius of the drill bit, the drill hole is sufficiently large to permit the casing tube to be driven down into the hole in a trouble-free manner.

When drilling is completed the drill rod is rotated in a direction opposite to that indicated by arrow 73, so as to return the adapter to the centric position, as a result of frictional engagement of the drill bit with the bottom of the drill hole. The arrangement can then be withdrawn from the drill hole, without being hindered by the casing tube.

I claim:

1. A soil and rock drill adapter for connection between a rotatable drill rod and drill bit such as to enable the drill bit to be positioned eccentrically in relation to the longitudinal axis of the drill rod, said adapter comprising two mutually connected parts arranged one above the other and abutting each other in a plane extending at right angles to the longitudinal axis of the drill rod and provided with means which enable mutual adjustment of said adapter parts between an eccentric position and a centric position relative to said axis and wherein each of said adapter parts includes an end piece and a journal plate, and wherein the journal plates are pivotally connected together by means of a pivot means and pivot-restricting means, and are firmly connected to associated end pieces by means of screw fastener means.

2. A drill adapter according to claim 1, wherein the adapter parts are connected to one another through an eccentrically positioned pivot means and exhibit mutually engaging pivot-restricting means.

3. A drill adapter according to claim 1, wherein an open fluid-conducting channel extends through said adapter.

4. A drill adapter according to claim 1, wherein the pivot restricting means include at least one peg which is spaced radially from the pivot means and one end part of which is firmly accommodated in a bore located in the one journal plate and the other end part of which is accommodated in a circle-arcuate slot extending around said pivot means and located in said second journal plate.

* * * * *